US009931736B2

(12) United States Patent
Lyons

(10) Patent No.: US 9,931,736 B2
(45) Date of Patent: Apr. 3, 2018

(54) CUTTING ELEMENTS FOR EARTH-BORING TOOLS, EARTH-BORING TOOLS INCLUDING SUCH CUTTING ELEMENTS, AND METHODS OF FORMING CUTTING ELEMENTS FOR EARTH-BORING TOOLS

(71) Applicant: Baker Hughes Incorporated, Houston, TX (US)

(72) Inventor: Nicholas J. Lyons, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 574 days.

(21) Appl. No.: 14/598,476

(22) Filed: Jan. 16, 2015

(65) Prior Publication Data

US 2015/0121768 A1 May 7, 2015

Related U.S. Application Data

(62) Division of application No. 13/158,904, filed on Jun. 13, 2011, now Pat. No. 8,936,116.

(Continued)

(51) Int. Cl.

*E21B 10/46* (2006.01)
*E21B 10/16* (2006.01)

(Continued)

(52) U.S. Cl.

CPC ..... *B24D 18/0072* (2013.01); *B24D 3/007* (2013.01); *B24D 18/0009* (2013.01); *E21B 10/00* (2013.01); *E21B 10/5735* (2013.01)

(58) Field of Classification Search

CPC ..... E21B 10/00; E21B 10/16; E21B 10/46; E21B 10/5735; B24D 18/0072; B23F 21/06

See application file for complete search history.

(56) References Cited

U.S. PATENT DOCUMENTS 4,491,022 A 1/1985 De La Cruz
4,604,106 A 8/1986 Hall (Continued)

FOREIGN PATENT DOCUMENTS

EP 0594420 A1 4/1994
EP 1135229 B1 2/2004

(Continued)

OTHER PUBLICATIONS

U.S. Appl. No. 60/399,531, filed Jul. 30, 2002, titled Expandable Reamer Apparatus for Enlarging Boreholes While Drilling and Method of Use, to Radford et al.

(Continued)

*Primary Examiner* — Pegah Parvini

(74) *Attorney, Agent, or Firm* — TraskBritt

(57) ABSTRACT

Cutting elements for use with earth-boring tools include a cutting table having a base surface and a substrate having a support surface. An intermediate structure and an adhesion layer extend between the base surface of the cutting table and the support surface of the substrate. Earth-boring tools include such cutting elements. Methods for fabricating cutting elements for use with earth-boring tools include forming an intermediate structure on and extending from a support surface of a substrate and adhering a cutting table comprising a superabrasive material to the support surface of the substrate.

20 Claims, 4 Drawing Sheets

Related U.S. Application Data

(60) Provisional application No. 61/358,323, filed on Jun. 24, 2010.

(51) Int. Cl.

| | |
|---|---|
| ***B23F 21/06*** | (2006.01) |
| ***B24D 18/00*** | (2006.01) |
| ***E21B 10/573*** | (2006.01) |
| ***B24D 3/00*** | (2006.01) |
| ***E21B 10/00*** | (2006.01) |

(56) References Cited

U.S. PATENT DOCUMENTS

| | | | | |
|---|---|---|---|---|
| 5,449,388 | A | 9/1995 | Wiand | |
| 5,518,077 | A | 5/1996 | Blackman et al. | |
| 5,564,511 | A * | 10/1996 | Frushour | B23B 27/146 175/431 |
| 5,730,792 | A * | 3/1998 | Camilletti | C04B 41/5035 106/287.14 |
| 5,875,862 | A | 3/1999 | Jurewicz et al. | |
| 5,928,071 | A * | 7/1999 | Devlin | B23B 27/146 175/428 |
| 6,029,760 | A | 2/2000 | Hall | |
| 6,041,875 | A | 3/2000 | Rai et al. | |
| 6,054,693 | A | 4/2000 | Barmatz et al. | |
| 6,098,730 | A | 8/2000 | Scott et al. | |
| 6,187,068 | B1 | 2/2001 | Frushour et al. | |
| 6,488,106 | B1 | 12/2002 | Dourfaye | |
| 6,571,891 | B1 * | 6/2003 | Smith | E21B 10/567 175/428 |
| 7,070,635 | B2 | 7/2006 | Frushour | |
| 7,108,598 | B1 | 9/2006 | Galloway | |
| 7,287,610 | B2 | 10/2007 | Svendsen et al. | |
| 7,350,601 | B2 | 4/2008 | Belnap et al. | |
| 7,368,079 | B2 | 5/2008 | Yao et al. | |
| 7,377,341 | B2 | 5/2008 | Middlemiss et al. | |
| 7,389,828 | B2 | 6/2008 | Ritter et al. | |
| 7,435,478 | B2 | 10/2008 | Keshavan | |
| 7,462,003 | B2 | 12/2008 | Middlemiss | |
| 7,487,849 | B2 | 2/2009 | Radtke | |
| 7,493,972 | B1 | 2/2009 | Schmidt et al. | |
| 7,493,973 | B2 | 2/2009 | Keshavan et al. | |
| 7,628,234 | B2 | 12/2009 | Middlemiss | |
| 7,647,993 | B2 | 1/2010 | Middlemiss | |
| 7,776,256 | B2 | 8/2010 | Smith et al. | |
| 7,802,495 | B2 | 9/2010 | Oxford et al. | |
| 7,900,717 | B2 | 3/2011 | Radford et al. | |
| 7,942,219 | B2 | 5/2011 | Keshavan et al. | |
| 8,028,771 | B2 | 10/2011 | Keshavan et al. | |
| 8,061,454 | B2 | 11/2011 | Voronin et al. | |
| 8,197,936 | B2 | 6/2012 | Keshavan | |
| 8,235,144 | B2 | 8/2012 | Rasheed | |
| 8,272,295 | B2 | 9/2012 | Smith et al. | |
| 8,328,891 | B2 | 12/2012 | Zhang et al. | |
| 8,511,404 | B2 | 8/2013 | Rasheed | |
| 8,528,668 | B2 | 9/2013 | Rasheed | |
| 9,097,820 | B2 | 8/2015 | Rasheed | |
| 2004/0119607 | A1 | 6/2004 | Davies et al. | |
| 2004/0134687 | A1 | 7/2004 | Radford et al. | |
| 2005/0263328 | A1 | 12/2005 | Middlemiss | |
| 2006/0162969 | A1 | 7/2006 | Belnap et al. | |
| 2006/0166615 | A1 | 7/2006 | Tank et al. | |
| 2006/0249307 | A1 | 11/2006 | Ritter et al. | |
| 2006/0260850 | A1 | 11/2006 | Roberts et al. | |
| 2006/0266558 | A1 * | 11/2006 | Middlemiss | B22F 7/062 175/426 |
| 2006/0266559 | A1 * | 11/2006 | Keshavan | B01J 3/062 175/428 |
| 2007/0023206 | A1 * | 2/2007 | Keshavan | E21B 10/16 175/374 |
| 2007/0029114 | A1 | 2/2007 | Middlemiss | |
| 2007/0079994 | A1 | 4/2007 | Middlemiss | |
| 2007/0102198 | A1 | 5/2007 | Oxford et al. | |
| 2007/0163808 | A1 | 7/2007 | Campbell et al. | |
| 2007/0205022 | A1 | 9/2007 | Treviranus et al. | |
| 2007/0284152 | A1 | 12/2007 | Eyre et al. | |
| 2008/0128175 | A1 | 6/2008 | Radford et al. | |
| 2008/0142276 | A1 | 6/2008 | Griffo et al. | |
| 2008/0178535 | A1 | 7/2008 | Wan | |
| 2008/0179109 | A1 | 7/2008 | Belnap et al. | |
| 2009/0022952 | A1 | 1/2009 | Keshavan | |
| 2009/0032169 | A1 | 2/2009 | Dourfaye et al. | |
| 2009/0114454 | A1 | 5/2009 | Belnap et al. | |
| 2009/0260895 | A1 * | 10/2009 | Vail | B01J 3/062 175/434 |
| 2010/0108394 | A1 | 5/2010 | Ollerenshaw et al. | |
| 2010/0282511 | A1 | 11/2010 | Maranuk et al. | |
| 2011/0023375 | A1 | 2/2011 | Sani et al. | |
| 2011/0036643 | A1 | 2/2011 | Belnap et al. | |
| 2011/0088954 | A1 | 4/2011 | DiGiovanni et al. | |
| 2011/0315456 | A1 | 12/2011 | Lyons | |
| 2013/0333879 | A1 | 12/2013 | Rasheed | |
| 2014/0060933 | A1 | 3/2014 | Rasheed | |

FOREIGN PATENT DOCUMENTS

| | | | |
|---|---|---|---|
| EP | 1614852 | A1 | 11/2006 |
| EP | 2327857 | B1 | 3/2014 |
| GB | 2319276 | B | 2/2001 |
| GB | 2353310 | A | 2/2001 |
| GB | 2393461 | B | 10/2006 |
| GB | 2426269 | B | 2/2007 |
| GB | 2441286 | B | 3/2008 |
| GB | 2438333 | B | 12/2008 |
| GB | 2437878 | B | 7/2009 |
| GB | 2446745 | B | 8/2009 |
| GB | 2460096 | A | 11/2009 |
| GB | 2420803 | B | 1/2010 |
| GB | 2465504 | A | 5/2010 |
| GB | 2465505 | A | 5/2010 |
| GB | 2449594 | B | 11/2010 |
| GB | 2476653 | A | 6/2011 |
| GB | 2455242 | B | 7/2011 |
| GB | 2470159 | B | 7/2012 |
| GB | 2473561 | B | 7/2012 |
| GB | 2479298 | B | 12/2013 |
| GB | 2521528 | A | 6/2015 |
| WO | 9929465 | A1 | 6/1999 |
| WO | 0020149 | A1 | 4/2000 |
| WO | 0034001 | A1 | 6/2000 |
| WO | 2008104944 | A1 | 9/2008 |
| WO | 2008/150290 | A1 | 12/2008 |
| WO | 2009/156552 | A1 | 12/2009 |
| WO | 2011/080640 | A2 | 7/2011 |
| WO | 2013/166393 | A1 | 11/2013 |

OTHER PUBLICATIONS

Chinese Office Action and Search Report for Chinese Application No. 201180031336.9 dated Jul. 3, 2014, 15 pages.

International Preliminary Report on Patentability for International Application No. PCT/US2011/040166 dated Dec. 28, 2012, 5 pages.

International Search Report for International Application No. PCT/US2011/040166 dated Dec. 9, 2011, 3 pages.

International Written Opinion for International Application No. PCT/US2011/040166 dated Dec. 9, 2011, 4 pages.

Chinese Office Action for Chinese Application No. 201180031336.9 dated Feb. 15, 2015, 4 pages.

European Search Report in European Application No. EP11798627 dated Jul. 13, 2016, 6 pages.

Notice of Decision for Saudi Arabia Patent Application No. 111320535, 8, pages.

* cited by examiner

CUTTING ELEMENTS FOR EARTH-BORING TOOLS, EARTH-BORING TOOLS INCLUDING SUCH CUTTING ELEMENTS, AND METHODS OF FORMING CUTTING ELEMENTS FOR EARTH-BORING TOOLS

CROSS-REFERENCE TO RELATED APPLICATIONS

This application is a divisional of U.S. patent application Ser. No. 13/158,904, filed Jun. 13, 2011, pending, which application claims the benefit of U.S. Provisional Patent Application Ser. No. 61/358,323, filed Jun. 24, 2010, both entitled "Cutting Elements for Earth-Boring Tools, Earth-Boring Tools Including Such Cutting Elements, and Methods of Forming Cutting Elements for Earth-Boring Tools," the disclosure of each of which is incorporated herein in its entirety by this reference.

TECHNICAL FIELD

Embodiments of the present disclosure generally relate to cutting elements, or cutters, for use with earth-boring drill bits and, more specifically, to cutting elements that include cutting tables adhered to substrates with an intermediate structure and adhesion layer disposed between the cutting tables and substrates. The present disclosure also relates to methods for manufacturing such cutting elements, as well as to earth-boring tools that include such cutting elements.

BACKGROUND

Earth-boring tools for forming wellbores in subterranean earth formations generally include a plurality of cutting elements secured to a body. For example, fixed-cutter earth-boring rotary drill bits (also referred to as "drag bits") include a plurality of cutting elements that are fixedly attached to a bit body of the drill bit. Similarly, roller cone earth-boring rotary drill bits may include cones that are mounted on bearing pins extending from legs of a bit body such that each cone is capable of rotating about the bearing pin on which it is mounted. A plurality of cutting elements may be mounted to each cone of the drill bit. In other words, earth-boring tools typically include a bit body to which cutting elements are attached.

The cutting elements used in such earth-boring tools often include so-called polycrystalline diamond compacts (PDCs), which employ a polycrystalline diamond material (PCD) as a shear-type cutter to drill subterranean formations. Conventional PDC cutting elements include a PCD cutting table and a substrate. The substrate conventionally comprises a metal material (e.g., a metal matrix composite such as cemented tungsten carbide), to enable robust coupling of the PDC cutting elements to a bit body. The cutting table typically includes randomly oriented, mutually bonded diamond (or, sometimes, cubic boron nitride (CBN) particles, in another, non-diamond superabrasive structure) that have been adhered to the substrate on which the cutting table is formed, under extremely high-temperature, high-pressure (HTHP) conditions. Catalyst material or binder material (e.g., cobalt binders) have been widely used to initiate bonding of diamond particles to one another and to the substrates, and catalyst material, usually in the form of cobalt, is often incorporated in the cemented tungsten carbide substrate.

Upon formation of a cutting table using a HTHP process, catalyst material may remain in interstitial spaces between the grains of diamond in the resulting PDC. The presence of the catalyst material in the cutting table may contribute to thermal damage in the cutting table when the cutting element is heated during use, due to friction at the contact point between the polycrystalline diamond cutting table of the cutting element and the formation.

PDC cutting elements in which the catalyst material remains in the PDC are generally thermally stable up to a temperature of about seven hundred and fifty degrees Celsius (750° C.), although internal stress within the cutting element may begin to develop at temperatures exceeding about three hundred and fifty degrees Celsius (350° C.). This internal stress is at least partially due to differences in the rates of thermal expansion between the cutting table and the cutting element substrate to which it is bonded. This differential in thermal expansion rates may result in relatively large compressive and tensile stresses at the interface between the cutting table and the substrate, and may cause the cutting table to delaminate from the substrate. At temperatures of about seven hundred and fifty degrees Celsius (750° C.) and above, stresses within the cutting table itself may increase significantly due to differences in the coefficients of thermal expansion of the diamond material and the catalyst material within the cutting table. For example, cobalt thermally expands significantly faster than diamond, which may cause cracks to form and propagate within the cutting table, eventually leading to deterioration of the cutting table and ineffectiveness of the cutting element.

Furthermore, at temperatures at or above about seven hundred and fifty degrees Celsius (750° C.), some of the diamond crystals within the PDC may react with the catalyst material causing the diamond crystals to undergo a chemical breakdown or back-conversion to another allotrope of carbon or another carbon-based material. For example, the diamond crystals may graphitize at the diamond crystal boundaries, which may substantially weaken the cutting table. In addition, at extremely high temperatures, in addition to graphite, some of the diamond crystals may be converted to carbon monoxide and carbon dioxide.

In order to reduce the problems associated with differential rates of thermal expansion and chemical breakdown of the diamond crystals in PDC cutting elements, so-called "thermally stable" PDCs (which are also known as thermally stable products or "TSPs") have been developed. Such a thermally stable PDC may be formed by leaching the binder or catalyst material (e.g., cobalt) out from interstitial spaces between the inter-bonded diamond crystals in the cutting table using, for example, an acid or combination of acids. Thermally stable PDCs in which substantially all catalyst material has been leached out from the cutting table have been reported to be thermally stable up to temperatures of about twelve hundred degrees Celsius (1,200° C.). Some conventional TSPs, instead of being leached of catalyst, also incorporate silicon material in voids between the diamond particles.

However, problems with such PDC cutting elements including cutting tables formed from TSP include difficulties in achieving a good attachment of the cutting table to a supporting substrate due largely to the lack of the solvent catalyst material within the body of the cutting table. In addition, silicon-filled TSPs do not bond easily to a substrate. Further difficulties include providing adequate support of the cutting table on the substrate during drilling operations. The substrate and cutting table of a TSP cutting element are generally bonded using a material (e.g., a brazing alloy or other adhesive material) having a relatively lower hardness as compared to the hardness of the cutting table and substrate. TSPs, and particularly leached TSPs with open voids between the diamond particles, have proven to be undesirably fragile if not adequately supported against loading experienced during drilling. During a drilling operation, the PDC cutting elements are subjected to relatively high forces and stresses as the PDC cutting elements are dragged along a subterranean formation as a drill bit to which they are secured is rotated under weight-on-bit (WOB) in order to form a borehole. As the cutting table is dragged along the formation, the material bonding the cutting table to the substrate, having a relatively lower hardness and less stiffness than either of the bonded components of the cutting element may compress or otherwise deform in a non-uniform manner, subjecting the cutting table to tensile stresses, or combined tensile and compressive stresses (e.g., bending) during drilling operations. Such stresses on the substantially inelastic PCD material of the cutting table may lead to crumbling and cracking of the polycrystalline diamond structure and result in failure of the cutting element due to failure of the cutting table or the bond at the interface between the cutting table and substrate.

BRIEF SUMMARY

In some embodiments, the present disclosure includes a cutting element for use with an earth-boring tool comprising a cutting table having a cutting surface and a base surface and a substrate having a support surface. The cutting element further includes an intermediate structure comprising a plurality of protrusions extending from a support surface of the substrate toward the base surface of the cutting table and an adhesion layer extending between the base surface of the cutting table and the support surface of the substrate.

In additional embodiments, the present disclosure includes a cutting element for use with an earth-boring tool comprising a cutting table having a cutting surface and a base surface and a substrate having a support surface. The cutting element further includes an intermediate structure disposed between the support surface of the substrate and the base surface of the cutting table and attached to a surface of at least one of the support surface of the substrate and the base surface of the cutting table. An adhesion layer extends around portions of the intermediate structure between the base surface of the cutting table and the support surface of the substrate.

In yet additional embodiments, the present disclosure includes an earth-boring tool comprising a tool body and at least one cutting element carried by the tool body. The at least one cutting element includes a cutting table having a cutting surface comprising a superabrasive material and a base surface and a substrate having a plurality of protrusions extending from a support surface of the substrate toward the base surface of the cutting table. The cutting element further includes an adhesion layer, in which the plurality of protrusions is embedded, extending between the base surface of the cutting table and the support surface of the substrate.

Further embodiments of the present disclosure include a method for fabricating a cutting element for use with an earth-boring tool comprising forming an intermediate structure comprising a plurality of protrusions on and extending from a support surface of a substrate and adhering a cutting table comprising a superabrasive material to the support surface of the substrate and the plurality of protrusions using an adhesive.

BRIEF DESCRIPTION OF THE DRAWINGS

While the specification concludes with claims particularly pointing out and distinctly claiming which are regarded as embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular material, apparatus, system, or method, but are merely idealized representations which are employed to describe the present disclosure. Additionally, elements common between figures may retain the same numerical designation.

Figure 1:
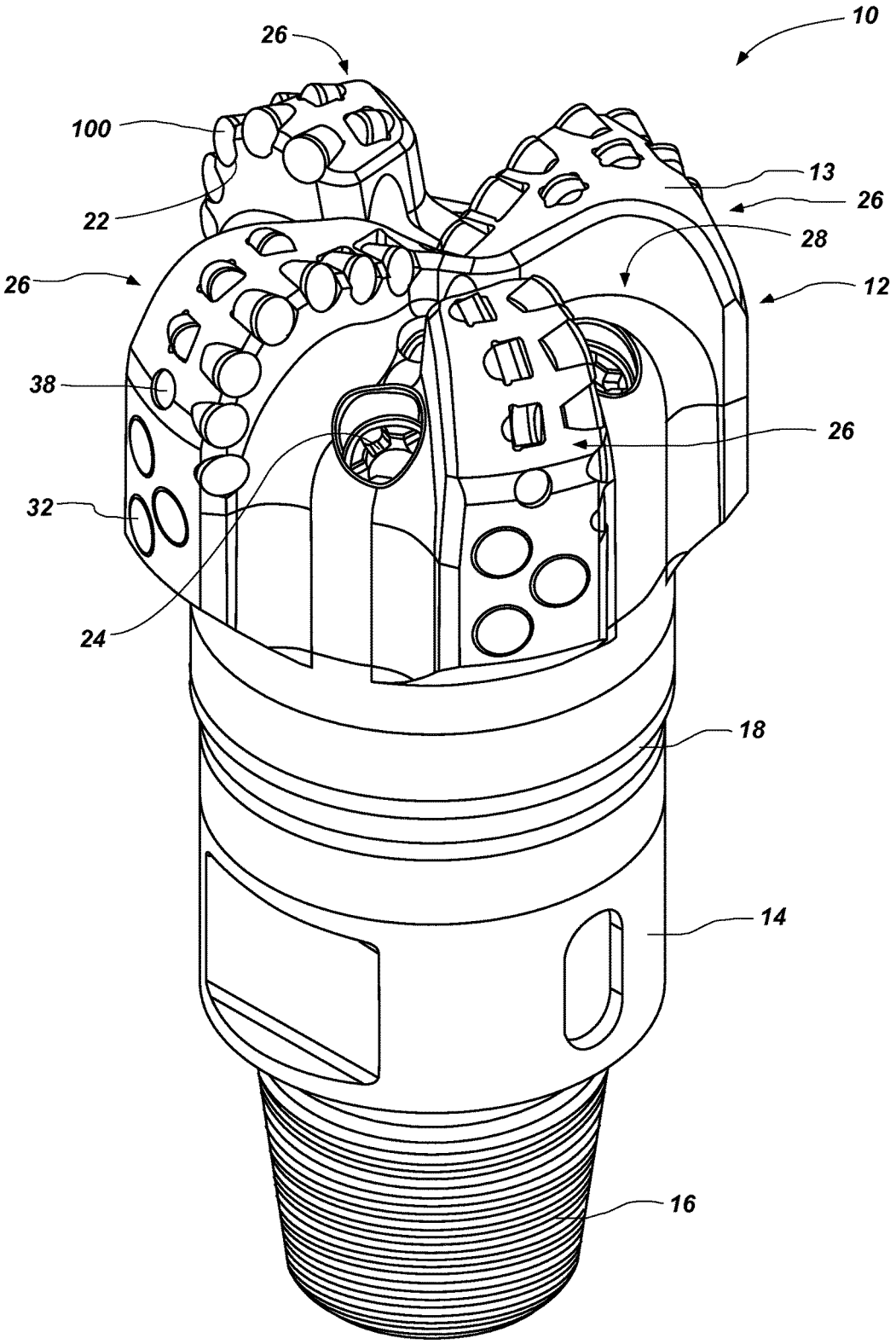
FIG. 1 is a perspective view of an earth-boring rotary drill bit that includes one or more cutting elements in accordance with embodiments of the present disclosure.

Embodiments of the present disclosure include cutting elements for use with earth-boring tools such as, for example, an earth-boring rotary drill bit. FIG. 1 is a perspective view of an earth-boring rotary drill bit 10. The earth-boring rotary drill bit 10 includes a bit body 12 that may be secured to a shank 14 having a threaded connection portion 16 (e.g., an American Petroleum Institute (API) threaded connection portion) for attaching the drill bit 10 to a drill string (not shown). The bit body 12 may be secured to the shank 14 using an extension 18 or may be secured directly to the shank 14.

The bit body 12 may include internal fluid passageways (not shown) that extend between the face 13 of the bit body 12 and a longitudinal bore (not shown), which extends through the shank 14, the extension 18, and partially through the bit body 12. Nozzle inserts 24 also may be provided at the face 13 of the bit body 12 within the internal fluid passageways. The bit body 12 may further include a plurality of blades 26 that are separated by junk slots 28. In some embodiments, the bit body 12 may include gage wear plugs 32 and wear knots 38. One or more cutting elements 100 in accordance with embodiments of the present disclosure may be mounted on the face 13 of the bit body 12 in cutting element pockets 22 that are located along each of the blades 26. The bit body 12 of the earth-boring rotary drill bit 10 shown in FIG. 1 may comprise a particle-matrix composite material that includes hard particles dispersed within a metallic matrix material.

Figure 2:
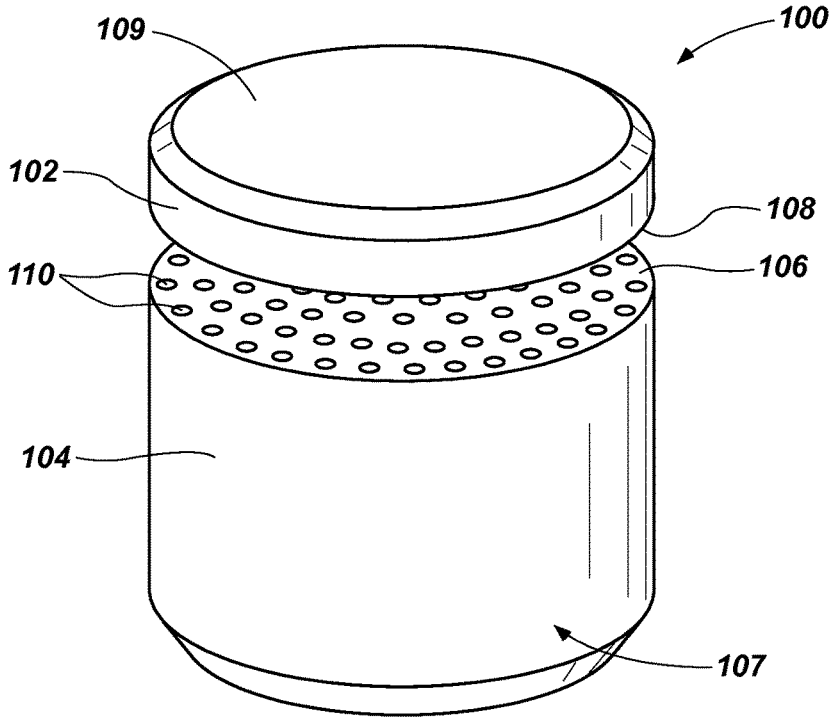
FIG. 2 is an exploded, perspective view of a cutting element in accordance with embodiments of the present disclosure for use with an earth-boring tool such as, for example, the earth-boring rotary drill bit shown in FIG. 1.

FIG. 2 illustrates an exploded, perspective view of a cutting element 100 for use with an earth-boring tool such as, for example, the earth-boring rotary drill bit 10 shown in FIG. 1. As shown in FIG. 2, cutting element 100 (e.g., a PDC cutting element) may include a cutting table 102 and a substrate 104. It is noted that while the embodiment of FIG. 2 illustrates the cutting element 100 as a cylindrical or disc-shaped, in other embodiments, the cutting element 100 may have any desirable shape, such as a dome, cone, chisel, etc. In some embodiments, the cutting table 102 may include a superabrasive material comprised of randomly oriented, mutually bonded superabrasive particles (e.g., a polycrystalline material such as diamond, cubic boron nitride (CBN), etc.) that are bonded under high-temperature, high-pressure (HTHP) conditions. For example, a cutting table having a polycrystalline structure may be formed from particles of a hard material such as diamond particles (also known as "grit") mutually bonded in the presence of a catalyst material such as, for example, a cobalt binder or other binder material (e.g., another Group VIII metal, such as nickel or iron, or alloys including these materials, such as Ni/Co, Co/Mn, Co/Ti, Co/Ni/V, Co/Ni, Fe/Co, Fe/Mn, Fe/Ni, Fe (Ni.Cr), Fe/$Si_2$, Ni/Mn, and Ni/Cr)) using a HTHP process. In some embodiments, the diamond material from which the polycrystalline structure is formed may comprise natural diamond, synthetic diamond, or mixtures thereof, and include diamond grit of different crystal sizes (i.e., from multiple layers of diamond grit, each layer having a different average crystal size, by using a diamond grit having a multi-modal crystal size distribution, or both). In some embodiments, the polycrystalline diamond material may be formed on a supporting substrate, or may be formed as freestanding structures.

In some embodiments, the cutting table 102 may comprise a thermally stable PDC, or TSP. For example, a catalyst material used to form the PDC may be substantially removed (e.g., by leaching, electrolytic processes, etc.) from the polycrystalline diamond material in the cutting table 102. Removal of the catalyst material from the cutting table 102 may be controlled to substantially uniformly remove the catalyst material from the polycrystalline diamond material in the cutting table 102. The catalyst material within the polycrystalline diamond material in the cutting table 102 may be substantially removed from interstitial spaces within the polycrystalline material and from surfaces of the bonded diamond particles of which the polycrystalline material is comprised. After the removal process, the polycrystalline material in the cutting table 102 may have a portion (e.g., a substantial portion), or even the entirety of the polycrystalline diamond material, which is rendered substantially free of catalyst material.

Figure 3:
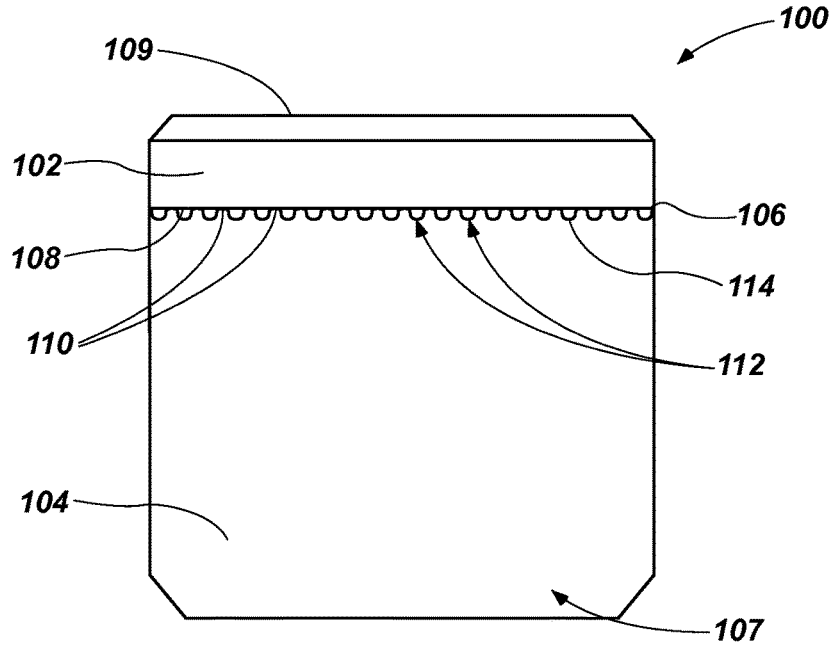
FIG. 3 is a side view of the cutting element shown in FIG. 2.

The substrate 104 may include a support surface 106 and a base portion 107. The base portion 107 of the substrate 104 may be attached (e.g., brazed) to an earth-boring tool (e.g., the earth-boring rotary drill bit 10 (FIG. 1)) after fabrication of the cutting element 100. The support surface 106 of the substrate 104 may be secured to the cutting table 102. As shown in FIGS. 2 and 3, the cutting table 102 may include a base surface 108 and a cutting surface 109. The cutting table 102 may be positioned on the substrate 104 such that the base surface 108 of the cutting table 102 is at least partially secured to the support surface 106 of the substrate 104. For example, the base surface 108 of the cutting table 102 may be secured to the support surface 106 of the substrate 104 at an adhesion layer 114 utilizing an adhesive process (e.g., a brazing process, a soldering process, a welding process, any suitable adhesive processes utilizing other adhesive materials, etc.). As used herein, the terms "adhesive" and "adhesion" are to be taken in their broadest sense to encompass the use of any bonding material, including metallurgical and non-metallurgical bonding materials, of a lesser hardness and stiffness than materials of two components bonded thereby. For example, the adhesion layer 114 may be formed by brazing the cutting table 102 to the substrate 104 using a braze alloy (e.g., TiCuSil). In some embodiments, the adhesion layer 114 may be formed by processes such as, for example, the microwave brazing processes disclosed in U.S. Pat. No. 6,054,693 to Barmatz et al., WIPO PCT Publication WO 1999/029465 A1, and WIPO PCT Publication WO 2000/034001 A1, and the entire disclosure of each of which is incorporated herein by this reference. In some embodiments, the adhesion layer 114 may include a braze alloy formed from materials such as those disclosed in U.S. Pat. No. 7,487,849 to Radtke, the entire disclosure of which is incorporated herein by this reference.

Figure 4A:
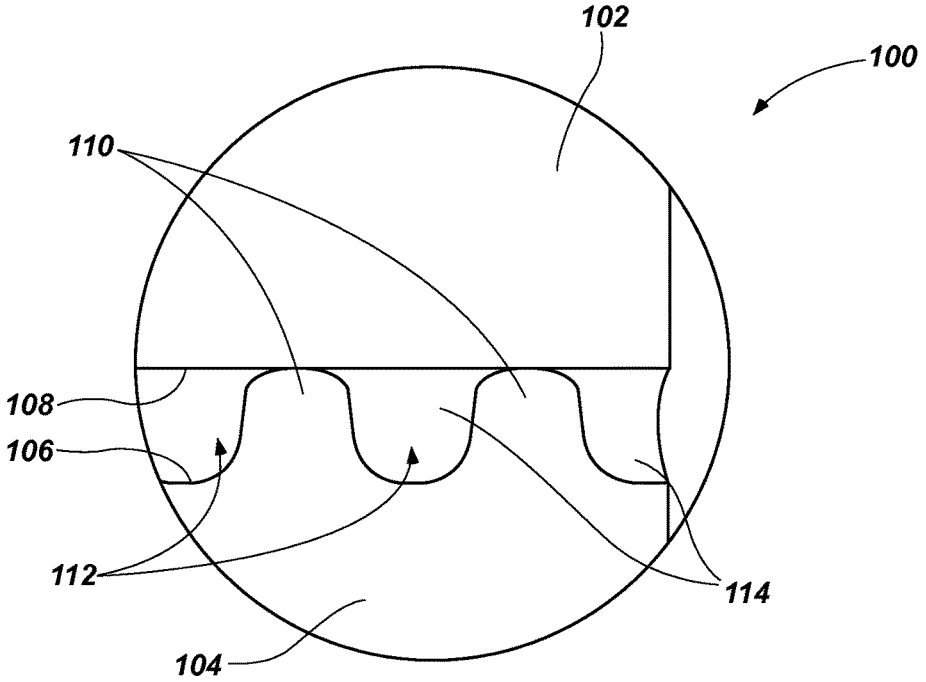
FIG. 4A is an enlarged partial view of the cutting element shown in FIG. 2.

The cutting element 100 may include an intermediate structure positioned between the substrate 104 and the cutting table 102. For example, a portion of the cutting element 100 (e.g., the substrate 104) may include a plurality of discrete protrusions 110 extending from the support surface 106 of the substrate 104. In some embodiments, the intermediate structure may be attached, prior to mutual securement thereof, to one of or both the cutting table 102 and the substrate 104. As shown in FIGS. 2 and 3, a plurality of protrusions 110 may extend from the support surface 106 of the substrate 104. Each of the plurality of protrusions 110 may extend from, or exhibit an exposure with respect to, the support surface 106 of the substrate 104 of substantially the same height. As discussed below in further detail, the protrusions 110 may be integrally formed as part of the substrate 104, may be otherwise attached or adhered to the support surface 106 of the substrate 104, or combinations thereof. The protrusions 110 extending from the support surface 106 may form one or more contiguous or noncontiguous voids 112 extending around and between the protrusions 110. As shown in FIGS. 3 and 4A, the adhesion layer 114 may be disposed within the voids 112 and may extend around and between the protrusions 110. In other words, the adhesion layer 114 disposed within the voids 112 extends between the support surface 106 of the substrate 104 and the base surface 108 of the cutting table 102. The adhesion layer 114 disposed within the voids 112 may act to secure the support surface 106 of the substrate 104 to the cutting table 102.

Referring still to FIG. 3, the protrusions 110 extending from the support surface 106 of the substrate 104 may form a multipoint, distributed support for the cutting table 102. For example, the protrusions 110 may extend from the support surface 106 toward the base surface 108 of the cutting table 102. In some embodiments, the surface opposing the protrusions 110 (e.g., the base surface 108 of the cutting table 102) may comprise a substantially planar surface. In any case, the base surface 108 of the cutting table 102 and the support surface 106 of the substrate 104 may be configured with a mutually cooperative topography so that a vertical (axial) distance between adjacent, superimposed portions of these components is substantially uniform, and a substantially uniform standoff between the components is provided by protrusions 110. In some embodiments, the protrusions 110 may be formed to have a width (i.e., a distance of the protrusions 110 measured along the support surface 106) that is relatively small when compared to a width of the support surface 106 of the substrate 104 (e.g., a width of between 20 microns and 2000 microns). Similarly, the protrusions 110 may exhibit an exposure, or height, above support surface 106 of the same or similar magnitude. It is desirable that the exposure of protrusions 110 be substantially uniform so as to provide substantially uniform support for all portions of the cutting table 102. Such a configuration of protrusions 110 may form a multipoint, distributed support having a relatively large numbers of protrusions 110 supporting the cutting table 102. For example, numerous protrusions 110 (e.g., tens, hundreds, thousands, etc., of protrusions 110) may extend from the support surface 106 of the substrate 104 to support the cutting table 102. As discussed below, in some embodiments, the protrusions 110 may comprise particles or grains of a selected material (e.g., particles of diamond, carbides, nitrides, oxides, borides, etc.). The protrusions 210 may be formed from particles of the selected material having a particle or grain size substantially smaller than an area of the support surface 106 of the substrate 104 to provide a multipoint support for the cutting table 102 (e.g., a particle or grain size, or nominal diameter, of between 20 microns and 2000 microns).

In some embodiments, while the protrusions 110 may exhibit an exposure above support surface 106, the protrusions 110 may exhibit different heights, extending from the support surface 106 of the substrate 104. For example, the support surface 106 of the substrate 104 may exhibit a contoured surface (e.g., a convex surface, a concave surface, a surface formed by concentric rings, combinations thereof, or any other suitable non-planar surface geometry). In such an embodiment, the protrusions 110 at relatively higher portions of the support surface 106 of the substrate 104 may have a height smaller than a height of the protrusions 110 at relatively lower portions of the support surface 106 of the substrate 104. For example, in a concave surface, the protrusions 110 proximate to the edge of the substrate 104 will exhibit a height less than the protrusions 110 proximate to the center of the substrate 104.

In some embodiments and as shown in FIG. 4A, the cutting table 102 may be secured to the substrate 104 such that the base surface 108 of the cutting table 102 is in direct contact with the protrusions 110 extending from the support surface 106 of the substrate 104. The adhesion layer 114 disposed within the voids 112 extending around and between the protrusions 110 may act to secure the support surface 106 of the substrate 104.

Figure 4B:
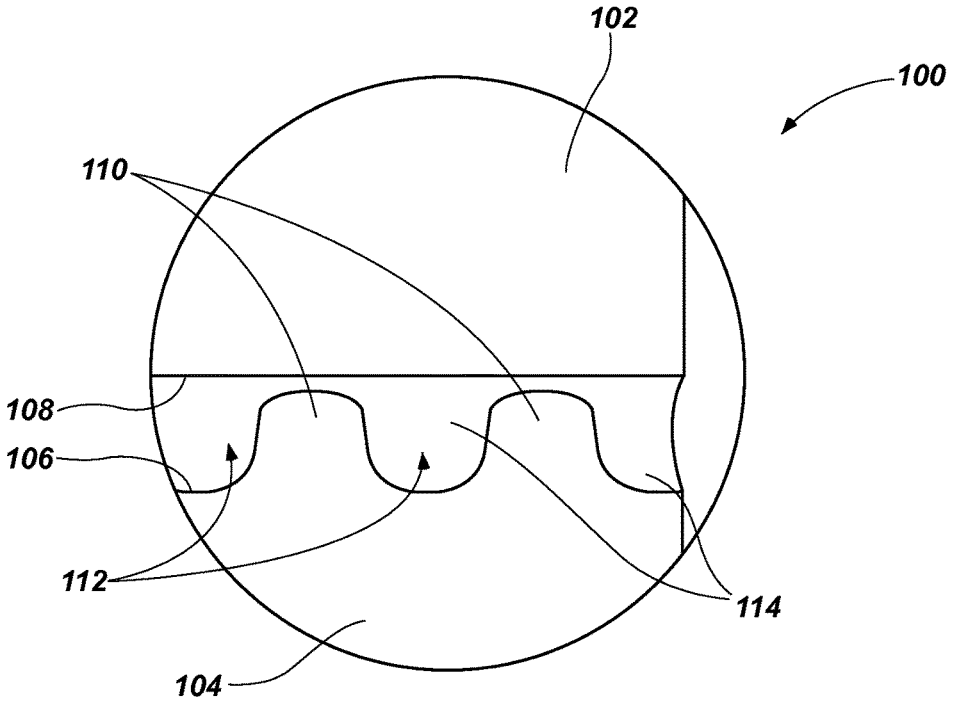
FIG. 4B is an enlarged partial view of the cutting element shown in FIG. 2 in accordance with additional embodiments of the present disclosure.

In other embodiments and as shown in FIG. 4B, the cutting table 102 may be secured to the substrate 104 such that the adhesion layer 114 extends around (e.g., over) distal ends of the protrusions 110 extending from the support surface 106 of the substrate 104. In other words, the adhesion layer 114 disposed within the voids 112 extends between the support surface 106 of the substrate 104 and the base surface 108 of the cutting table 102 and a portion of the adhesion layer 114 extends between the distal ends of the protrusions 110 formed on the substrate 104 and the base surface 108 of the cutting table 102. The adhesion layer 114 disposed within the voids 112 extending around and between the protrusions 110, including the distal ends of the protrusions 110, may act to secure the support surface 106 of the substrate 104. Such a configuration may act to support the cutting table 102 during drilling operations. For example, during a drilling operation, forces on the rutting table 102 may act to partially deform the adhesion layer 114, but for the presence of protrusions 110; however, the protrusions 110 act to limit the amount of stress on the cutting table 102 due to the inconsequential amount of deformation of the portions of the adhesion layer 114 between the distal ends of protrusions 110 and the cutting table 102.

In some embodiments, the distance between the distal end of the protrusions 110 formed on the substrate 104 and the base surface 108 of the cutting table 102 may exhibit a distance substantially (e.g., by an order of magnitude or more) smaller than the distance between the support surface 106 of the substrate 104 and the base surface 108 of the cutting table 102.

In some embodiments, an intermediate portion of the cutting element 100 (e.g., dimensions of the protrusions 110 and adhesion layer 114) may be sized to provide a cutting element 100 that exhibits relatively enhanced stiffness and toughness as compared to conventional cutting elements. For example, a distance between the distal end of the protrusions 110 and the base surface 108 of the cutting table 102 (e.g., a distance forming a void 113 between the distal end of the protrusions 110 and the base surface 108 of the cutting table 102 for a portion of the adhesion layer 114) may exhibit a distance of about 10 microns to 100 microns and a distance of exposure of the protrusions 110 may exhibit a distance of about 25 microns to 250 microns. Such a configuration may provide a cutting element 100 having an adhesion layer 114 enabling the cutting element 100 to absorb energy and deform without substantial fracturing (i.e., toughness) while the protrusions 110 will support the cutting table 102 by limiting the amount of deflection of the cutting table 102 (i.e., stiffness).

Referring back to FIG. 3, the substrate 104 and the protrusions 110 may be formed from materials having a hardness greater than the hardness of the adhesion layer 114 (e.g., a relatively softer braze alloy). For example, the substrate 104 may comprise a cemented carbide (e.g., tungsten carbide) substrate 104, or any other material that is suitable for use as a substrate for cutting elements. The protrusions 110 may be formed from hard, wear-resistant materials (materials including carbides, nitrides, oxides, borides, etc.) or superhard materials (e.g., materials having a Vickers hardness of greater than 40 GPa). In some embodiments, the protrusions 110 may be integrally formed with the substrate 104 and may comprise a similar material (e.g., tungsten carbide) or dissimilar material (e.g., silicon carbide cubic boron nitride (CBN), diamond grit, etc.) than the material of the substrate 104. In other embodiments, the protrusions 110 may include a material formed separately from the substrate 104 (e.g., particles or grains of diamond grit, cubic boron nitride (CBN), silicon carbide, etc.) that may be bonded or otherwise adhered to the substrate 104 after the substrate 104 is formed. For example, particles of a material may be sintered to the support surface 106 of the substrate 104 to form the protrusions 110.

In some embodiments, portions of the cutting element 100 (e.g., the substrate 104 or, in some embodiments, the substrate 104 and the protrusions 110) may be fabricated using powder metallurgical processes such as, for example, press and sintering processes, directed powder spraying, and laser sintering. For example, portions of the cutting elements 100 may be fabricated using powder compaction and sintering techniques such as, for example, those disclosed in pending U.S. patent application Ser. No. 11/271,153, now U.S. Pat. No. 7,802,495, issued Sep. 28, 2010, and pending U.S. patent application Ser. No. 11/272,439, now U.S. Pat. No. 7,776,256, issued Aug. 17, 2010, each of which is assigned to the assignee of the present disclosure, and the entire disclosure of each of which is incorporated herein by this reference. Broadly, the methods comprise injecting a powder mixture into a cavity within a mold to form a green body, and the green body then may be sintered to a desired final density to form the portions of the cutting elements 100. Such processes are often referred to in the art as metal injection molding (MIM) or powder injection molding (PIM) processes. The powder mixture may be mechanically injected into the mold cavity using, for example, an injection molding process or a transfer molding process. To form a powder mixture for use in embodiments of methods of the present disclosure, a plurality of hard particles may be mixed with a plurality of matrix particles that comprise a metal matrix material. In some embodiments, an organic material also may be included in the powder mixture. The organic material may comprise a material that acts as a lubricant to aid in particle compaction during a molding process.

The hard particles of the powder mixture may comprise diamond, or may comprise ceramic materials such as carbides, nitrides, oxides, and borides (including boron carbide ($B_4C$)). More specifically, the hard particles may comprise carbides and borides made from elements such as W, Ti, Mo, Nb, V, Hf, Ta, Cr, Zr, Al, and Si. By way of example and not limitation, materials that may be used to form hard particles include tungsten carbide (WC), titanium carbide (TiC), tantalum carbide (TaC), titanium diboride ($TiB_2$), chromium carbide ($Cr_3C_2$), titanium nitride (TiN), aluminum oxide ($Al_2O_3$), aluminum nitride (AlN), boron nitride (BN), silicon nitride ($Si_3N_4$), and silicon carbide (SiC). Furthermore, combinations of different hard particles may be used to tailor the physical properties and characteristics of the particle-matrix composite material.

The matrix particles of the powder mixture may comprise, for example, cobalt-based, iron-based, nickel-based, aluminum-based, copper-based, magnesium-based, and titanium-based alloys. The matrix material may also be selected from commercially pure elements such as cobalt, aluminum, copper, magnesium, titanium, iron, and nickel. By way of example and not limitation, the matrix material may include carbon steel, alloy steel, stainless steel, tool steel, Hadfield manganese steel, nickel or cobalt superalloy material, and low thermal expansion iron- or nickel-based alloys such as INVAR®. As used herein, the term "superalloy" refers to iron-, nickel-, and cobalt-based alloys having at least 12% chromium by weight. Additional example alloys that may be used as matrix material include austenitic steels, nickel-based superalloys such as INCONEL® 625M or RENE® 95, and INVAR® type alloys having a coefficient of thermal expansion that closely matches that of the hard particles used in the particular particle-matrix composite material. More closely matching the coefficient of thermal expansion of matrix material with that of the hard particles offers advantages such as reducing problems associated with residual stresses and thermal fatigue. Another example of a matrix material is a Hadfield austenitic manganese steel (Fe with approximately 12% Mn by weight and 1.1% C by weight).

In some embodiments, the portions of the cutting element 100 in contact with the adhesion layer 114 (e.g., the support surface 106 of the substrate 104 and, in some embodiments, the protrusions 110 formed on the support surface 106 of the substrate 104) may be processed to enhance subsequent adhesion of a preformed cutting table 102 thereto. Such processing of the portions of the cutting element 100 may, in some embodiments, include removal of one or more contaminants or materials that may weaken or otherwise interfere with optimal bonding of cutting table 102 to the portions of the cutting element 100.

In other embodiments, the surface area of portions of the cutting element 100 in contact with the adhesion layer 114 (e.g., the support surface 106 of the substrate 104 and, in some embodiments, the protrusions 110 formed on the support surface 106 of the substrate 104) may be increased. For example, chemical, electrical, and/or mechanical processes may be used to increase the surface area of the portions of the cutting element 100 by removing material from the portions of the cutting element 100. For example, techniques for increasing the surface area of the portions of the cutting element 100 include laser ablation, blasting with abrasive material, and exposure to chemical etchants.

In some embodiments, where the protrusions 110 are integrally formed from the substrate 104, the protrusions 110 on the support surface 106 of the substrate 104 may be formed by chemical, electrical, and/or mechanical processes used to increase the surface area of the portions of the cutting element 100 (e.g., as discussed above) by removing material from the portions of the cutting element 100. For example, the protrusions 110 may be formed by texturing or dimpling the support surface 106 of the substrate 104. By way of further example, techniques for foaming the protrusions 110 on the support surface 106 of the substrate 104 include machining (e.g., milling, electric discharge machining (EDM), grinding, etc.), laser ablation, blasting with abrasive material, and exposure to chemical etchants.

Figure 5:
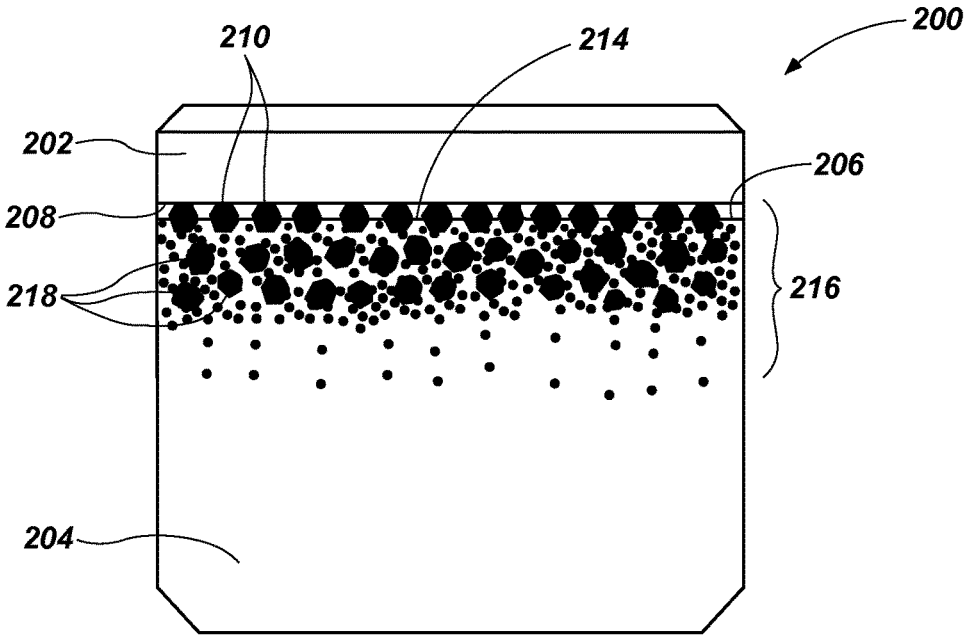
FIG. 5 is a longitudinal cross-sectional view of a cutting element in accordance with additional embodiments of the present disclosure for use with an earth-boring tool such as, for example, the earth-boring rotary drill bit shown in FIG. 1.
Figure 6:
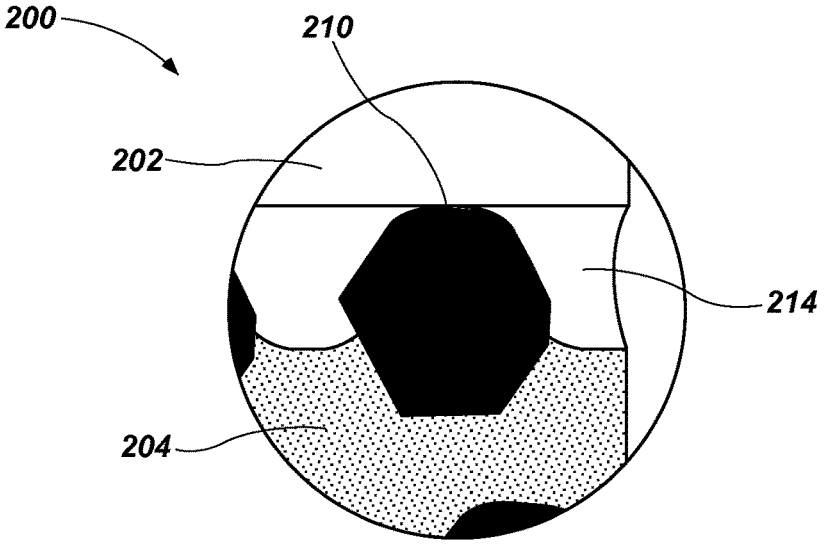
FIG. 6 is an enlarged partial view of the cutting element shown in FIG. 5.

FIG. 5 is a longitudinal cross-sectional view of a cutting element 200 for use with an earth-boring tool such as, for example, the earth-boring rotary drill bit 10 shown in FIG. 1. FIG. 6 is an enlarged partial view of the cutting element 200. As shown in FIGS. 5 and 6, the cutting element 200 may be similar to the cutting element 100 shown and described with reference to FIGS. 2, 3, 4A, and 4B (e.g., the cutting element 200 may include a void between the distal end of the protrusions and the cutting table, as shown in FIG. 4B) and may include a cutting table 202, a substrate 204, an intermediate structure (e.g., a plurality of protrusions 210 extending from the support surface 206 of the substrate 204), and an adhesion layer 214. The protrusions 210 may be adhered or otherwise bonded to the substrate 204. In some embodiments, a support portion 216 of the substrate 204 may contain particles or grains of a support material 218 (e.g., particles of diamond, carbides, nitrides, oxides, borides, etc.) formed in or on the support portion 216 of the substrate 204. For example, the material 218 may include diamond grit (e.g., natural or synthetic diamond grit), macro-crystalline tungsten carbide grit, etc., impregnated in the substrate 204. The support material 218 may extend through the support portion 216, of the substrate 204 to the support surface 206 in order to form the protrusions 210. In some embodiments, the support material 218 may be gradated as the material 218 extends through the support portion 216 of the substrate 204 and the concentration of the material 218 may increase as the support material 218 approaches the support surface 206 of the substrate 204. It is noted that while the embodiment of FIGS. 5 and 6 illustrate the support material 218 extending through the support portion 216 of the substrate 204, the support material 218 may be disposed in any suitable manner in the substrate 204. For example, the support material 218 may be disposed only proximate the support surface 206. In other embodiments, the support material 218 may be disposed throughout the entire substrate 204. In some embodiments and as shown in FIGS. 5 and 6, the support material 218 forming the protrusions 210 may be partially disposed (i.e., embedded) in the substrate 204. In other embodiments, the support material 218 forming the protrusions 210 may be disposed on the support surface 206 of the substrate 204.

Although embodiments of methods of the present disclosure have been described hereinabove with reference to cutting elements for earth-boring rotary drill bits, the present disclosure may be used to form cutting elements for use with earth-boring tools and components thereof other than fixed-cutter rotary drill bits including, for example, other components of fixed-cutter rotary drill bits, roller cone bits, hybrid bits incorporating fixed cutters and rolling cutting structures, core bits, eccentric bits, bicenter bits, reamers, mills, and other such tools and structures known in the art. Accordingly, the term "earth-boring tool" encompasses all of the foregoing tools and structures.

Embodiments of the present disclosure may be particularly useful in forming cutting elements for earth-boring tools that provide improved structural support between the cutting tables and the substrates of cutting elements. For example, such configurations may provide cutting elements where an intermediate structure supplies additional support under bending and tensile stresses to a cutting table, which may reduce the tendency of failure of the cutting element under such stresses during drilling operations as compared to other conventional cutting elements. As discussed above, configurations of the adhesion layer between the cutting table and substrate of a conventional cutting element may introduce stresses to the cutting table and the interface between the cutting table and the substrate due to a relatively softer adhesion layer allowing the cutting table to flex and deform during drilling operations. Such flexure and deformation may cause the cutting element to fail during drilling operations due to failure of the cutting table or failure of the interface between the cutting table and the substrate. Conventional cutting elements including TSP cutting tables may particularly exhibit problems related to the bonding of the substrate to the TSP cutting table. Cutting elements in accordance with embodiments of the present disclosure may provide a cutting element providing greater support and stiffness for the cutting table mounted on a substrate with an intermediate structure and an adhesion layer disposed therebetween. Such configurations may be relatively less susceptible to failure of the cutting elements due to failure of the cutting table or failure of the interface between the cutting table and the substrate. The intermediate structure may also provide additional surface area over which the adhesion layer is applied in order to strengthen the bond between the cutting table and the substrate.

While the present disclosure has been described herein with respect to certain embodiments, those of ordinary skill in the art will recognize and appreciate that it is not so limited. Rather, many additions, deletions and modifications to the described embodiments may be made without departing from the scope of the disclosure as hereinafter claimed, including legal equivalents. In addition, features from one embodiment may be combined with features of another embodiment while still being encompassed within the scope of the disclosure as contemplated by the inventors.

What is claimed is:

1. A method for fabricating a cutting element for use with an earth-boring tool, comprising:

forming an intermediate structure comprising a plurality of discrete protrusions on and extending from a support surface of a substrate positioned within an outer boundary of the support surface of the substrate;

positioning a planar base surface of a cutting table comprising a superabrasive material directly on the plurality of protrusions and over the support surface of the substrate to define voids between the support surface of the substrate and the planar base surface of the cutting table, the cutting table having a cutting surface on one side and the planar base surface on a second, opposing side; and adhering the cutting table to the support surface of the substrate and the plurality of protrusions using an adhesive, the adhesive at least partially filling the voids between the support surface of the substrate and the planar base surface of the cutting table.

2. The method of claim 1, further comprising forming the intermediate structure from a material exhibiting a hardness greater than a hardness of a material forming the substrate.

3. The method of claim 1, wherein forming an intermediate structure comprises:

forming the substrate and the plurality of protrusions from a powder mixture; and pressing and sintering the powder mixture to form a unitary sintered structure comprising the substrate and the plurality of protrusions.

4. The method of claim 1, further comprising forming a TSP cutting table by at least partially leaching a catalyst from the cutting table.

5. The method of claim 1, wherein adhering the cutting table comprises adhering the cutting table to the substrate and the plurality of protrusions using a brazing process.

6. The method of claim 1, wherein adhering the cutting table comprises flowing a brazing material into the voids defined by the plurality of protrusions and extending between the cutting table and the substrate.

7. The method of claim 1, wherein forming an intermediate structure comprises locating at least one of diamond grit, particles of cubic boron nitride, and particles of silicon carbide on the support surface of the substrate.

8. The method of claim 7, wherein locating at least one of diamond grit, particles of cubic boron nitride, and particles of silicon carbide on the support surface of the substrate comprises selecting the at least one of diamond grit, particles of cubic boron nitride, and particles of silicon carbide to have a uniform average particle size of between 10 microns and 100 microns.

9. The method of claim 1, further comprising extending each protrusion of the plurality of protrusions from the support surface of the substrate to a base surface of the cutting table.

10. The method of claim 9, further comprising contacting the base surface of the cutting table with each protrusion of the plurality of protrusions.

11. The method of claim 1, further comprising:

selecting the substrate to comprises tungsten carbide; and forming the plurality of protrusions from a material relatively harder than the tungsten carbide of the substrate.

12. A method for fabricating a cutting element for use with an earth-boring tool, the method comprising:

forming an intermediate structure comprising a plurality of particles secured to and protruding from a support surface of a substrate, the plurality of particles being separate from the substrate prior to the forming of the intermediate structure; and adhering a cutting table comprising a superabrasive material to the support surface of the substrate and the plurality of particles using an adhesive.

13. The method of claim 12, further comprising:

selecting the cutting table to have a cutting surface on one side and a planar base surface on a second, opposing side; and positioning the planar base surface of the cutting table over the support surface proximate the plurality of particles.

14. The method of claim 12, further comprising adhering the plurality of particles to the support surface of the substrate.

15. The method of claim 12, further comprising forming the plurality of particles from at least one of diamond grit, carbide particles, nitride particles, oxide particles, and boride particles.

16. The method of claim 12, further comprising forming the plurality of particles with a plurality of carbide particles comprising at least one of tungsten carbide, cubic boron nitride, and silicon carbide.

17. The method of claim 12, further comprising selecting the plurality of particles to comprise a uniform particle size in a size range between 0.1 micron and 40 microns.

18. A method for fabricating a cutting element for use with an earth-boring tool, the method comprising:

forming a plurality of protrusions comprising a first material on and protruding from a support surface of a substrate comprising a second material;

selecting the first material of the plurality of protrusions to exhibit a hardness greater than a hardness of the second material of the substrate; and adhering a cutting table comprising a superabrasive material to the support surface of the substrate and the plurality of protrusions using an adhesive.

19. A method of forming an earth-boring tool, the method comprising:

providing a tool body; and coupling at least one cutting element formed by the method recited in claim 1 to the tool body.

20. A method of forming an earth-boring tool, the method comprising:

providing a tool body; and coupling at least one cutting element formed by the method recited in claim 12 to the tool body.

* * * * *